United States Patent [19]

van Manen

[11] 4,019,654

[45] Apr. 26, 1977

[54] MANUAL CARTRIDGE DISPENSER

[75] Inventor: Dick T. van Manen, Canandaigua, N.Y.

[73] Assignee: Voplex Corporation, Pittsford, N.Y.

[22] Filed: Feb. 25, 1976

[21] Appl. No.: 661,294

[52] U.S. Cl. ..... 222/1; 222/80; 222/85; 222/327; 222/390

[51] Int. Cl.[2] ..... B65D 83/00

[58] Field of Search ..... 222/327, 390, 80, 85, 222/1

[56] References Cited

UNITED STATES PATENTS

| | | | |
|---|---|---|---|
| 1,923,974 | 8/1933 | Hand | 222/390 |
| 2,768,768 | 10/1956 | Cornell et al. | 222/80 |

FOREIGN PATENTS OR APPLICATIONS

| | | | |
|---|---|---|---|
| 15,429 | 6/1915 | United Kingdom | 222/390 |

*Primary Examiner*—Robert B. Reeves
*Assistant Examiner*—Frederick R. Handren
*Attorney, Agent, or Firm*—Stonebraker, Shepard & Stephens

[57] ABSTRACT

A dispenser of the type using a threaded rod with a turning knob is applied to a disposable cartridge and plunger. The cartridge plunger has a threaded central sleeve that is sealed closed, and the threaded rod, knob, and an anchorage adapter are separate from the cartridge until dispensing is to begin. Then the rod is threaded through the sleeve to puncture the seal and advance through the material to bring the anchorage adapter adjacent the rear end of the cartridge. The anchorage adapter is then releasably secured to the rear end of the cartridge, and the rod turned in the opposite direction to advance the plunger for dispensing material. The plunger can be backed up to stop drool if dispensing is interrupted, and the rod, knob, and adapter can be removed and reused after dispensing is completed.

12 Claims, 1 Drawing Figure

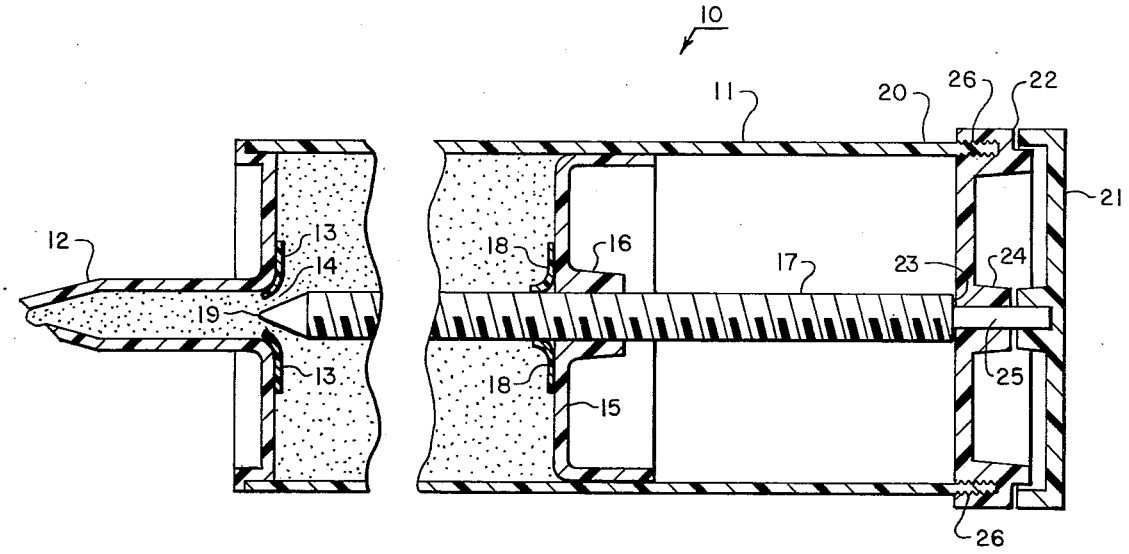
10
11
20
26
22
21
12
13
14
19
13
18
16
17
23
24
25
18
15
26

MANUAL CARTRIDGE DISPENSER

BACKGROUND OF THE INVENTION

Many dispensers have been suggested for dispensing sealant or caulking compounds from cartridges, and these usually involve some sort of holder or gun that advances the plunger through the cartridge. The invention involves recognition of a simple and economical way of eliminating the dispenser gun and using simple dispenser components that are releasably attachable to a series of disposable cartridges. The dispenser mechanism involved is the type using a threaded rod turned by a knob for advancing a threaded plunger, and although this type of dispenser was suggested in U.S. Pat. No. 2,744,664, the invention goes beyond this in simplifying and economizing on the structural elements involved and making dispenser components that are reusable on a series of disposable containers. The invention aims not only at eliminating separate dispenser guns, but reducing the cost and increasing the efficiency and convenience of manual dispensers for disposable cartridges.

SUMMARY OF THE INVENTION

The inventive dispenser is the type using a threaded rod with a turning knob for advancing a threaded plunger through a cartridge, but the invention is applied to a disposable cartridge and plunger. The plunger is molded of resin material and has a central sleeve with an internal screw thread and a seal puncturable by the advancing rod for sealing the opening through the sleeve. An anchorage adapter has a central sleeve mounted on an unthreaded portion of the rod adjacent the turning knob, and the rod turns freely within the adapter but does not move axially relative to the adapter. The rod, adapter, and knob are separate from the cartridge and plunger until dispensing is to commence, and then the adapter is manually securable to the rear end of the cartridge after the rod is threaded through the plunger and the seal. When dispensing is completed by driving the plunger forward on the rod by turning the knob, the knob, adapter, and rod can be removed from the cartridge and reused.

The inventive method uses similar equipment and involves turning the knob and the rod in one direction to thread the rod through the plunger and seal and to advance the rod through the material to bring the adapter adjacent the rear end of the cartridge. Then the adapter is manually secured to the rear end of the cartridge and the knob is turned in the opposite direction to advance the plunger to dispense the material. The knob is turned slightly back in the first direction to retract the plunger to prevent drool if the dispensing is interrupted, and the adapter is preferably removable from the rear end of the cartridge after completing the dispensing so that the rod, knob, and adapter can be reused on another cartridge.

DRAWING

The drawing shows a longitudinal, cross-sectional view of a preferred embodiment of the inventive dispenser.

DETAILED DESCRIPTION

The invention applies to a disposable cartridge 10 having a cylindrical barrel or body 11 formed in any of several generally known ways, and preferably formed as an extruded resin tube. The forward end of cartridge 10 has a dispenser nozzle 12, and for some materials, a puncturable seal 13 is preferably arranged over the opening 14 into dispenser nozzle 12.

Plunger 15 has a central sleeve 16 with internal screw threads mating with the screw threads on rod 17. The opening through sleeve 16 is initially sealed, either by a separate seal 18, or by a resin membrane extending across the opening through sleeve 16 and formed when plunger 15 is molded of resin material. Either way, an integral, sealing membrane of the same resin material as used to form plunger 15, or the separate seal 18 of foil or resin material, are thin enough to be punctured by rod 17, which preferably has a pointed tip 19 for this purpose.

When cartridge 10 is prepared and sold, either with or without seal 13, cartridge 10 is filled with a sealant or caulking material, and plunger 15, with a seal over the opening through central sleeve 16, is seated a little inside the rear end 20 of cartridge 10. The other components of the inventive dispenser include threaded rod 17, turning knob 21, and adapter 22, and these are sold separately, but possibly accompanying, cartridge 10.

Rod 17 has a shoulder 23 where the threads terminate near the rear end of rod 17, and adapter 22 has a sleeve 24 loosely surrounding an unthreaded portion 25 of rod 17 so that rod 17 is freely rotatable within sleeve 24. Turning knob 21 is firmly secured to the end of unthreaded portion 25 of rod 17 for turning rod 17 with knob 21. Adapter 22 cannot move axially of rod 17, because adapter 22 is trapped between knob 21 and shoulder 23.

Adapter 22 is manually attachable to rear end 20 of cartridge body 11, and although there are several ways this can be done, adapter 22 preferably has screw threads 26 and is formed of resin material substantially harder than the resin material of body 11 so that threads 26 can be screwed onto the rear end 20 of body 11 in a self-tapping fashion for securely anchoring adapter 22 to cartridge 10.

When dispensing from cartridge 10 is desired, rod 17, adapter 22, and knob 21 are manually grasped for turning knob 21 and rod 17 to screw rod 17 through sleeve 16 of plunger 15. The pointed end 19 of rod 17 punctures seal 18 or other membrane seal of plunger 15, and knob 21 is turned sufficiently to screw rod 17 through plunger 15, into the material in cartridge 10, and up to the region of the optional seal 13 over the opening 14 to nozzle 12. This brings adapter 22 adjacent the rear end 20 of cartridge body 11, and adapter 22 is manually advanced onto the rear end 20 of body 11, by screw threading or other attaching motions for securely but releasably anchoring adapter 22 to the rear end 20 of body 11. One preferred way of accomplishing this is to turn knob 21 and adapter 22 counterclockwise together for threading rod 17 farther through plunger 15 as threads 26 of adapter 22 are self tapped onto rear end 20 of body 11. When adapter 22 is fully secured to body 11, the counterclockwise advance is stopped. Adapter 22 can also be threaded clockwise onto rear end 20 of body 11 or can be attached in a bayonnet fashion or by motions suitable to some other form of interlock with rear end 20.

In the process of threading rod 17 through plunger 15, some of the material in cartridge 10 is displaced and tends to force plunger 15 rearwardly, so plunger 15 is preferably initially set inward from rear end 20 of body 11 to allow room for rearward displacement as rod 17 advances to the region of nozzle 12.

After rod 17 is fully threaded through plunger 15 and adapter 22 is securely anchored on cartridge 10, knob 21 is then turned in the opposite direction (clockwise relative to the threading described above), and this advances plunger 15 along rod 17. The frictional engagement of plunger 15 with the inside of cartridge body 11 and with the material in cartridge 10 is sufficient to prevent free rotation of plunger 15 so that it advances along the threads on rod 17 as rod 17 is turned by knob 21.

If dispensing is interrupted, knob 21 is turned in the opposite direction, or counterclockwise, according to the preferred mode, for retracting plunger 15 to prevent drool of material from nozzle 12 because of compression force on the material. Dispensing is then resumed when desired by again turning knob 21 in the proper direction for advancing plunger 15.

When dispensing is completed, adapter 22 is preferably manually removed from rear end 20 of body 11 to withdraw rod 17 from dispenser 10, either before or after unthreading rod 17 from plunger 15. When plunger 15 is removed from rod 17, then adapter 22, rod 17, and knob 21 can be reused on another disposable cartridge 10.

Although the threads of rod 17 enter the material in cartridge 10 before dispensing begins, the advance of plunger 15 along rod 17 cleans the threads so that rod 17 is relatively clean and ready for reuse after plunger 15 has advanced the full length of rod 17.

The inventive use of rod 17, adapter 22, and knob 21 provides a simple, economical, and convenient replacement for conventional gun dispensers, and the complete cartridge and dispenser components are compact, lightweight, and easily operated. Those skilled in the art will appreciate the many ways that adapter 22 can be securely anchored to cartridge 10 with simple, manual movements, and will also appreciate the many different materials and configurations that can be used within the spirit of the invention.

What is claimed is:

1. A dispenser of the type using a threaded rod with a turning knob for advancing a threaded plunger along said rod and through a cartridge toward a nozzle opening of said cartridge, said dispenser being applied to a disposable cartridge and plunger and comprising:

a. said plunger being molded of resin material and having a central sleeve with an internal screw thread;

b. means puncturable by said rod advancing through said sleeve for sealing the opening through said sleeve;

c. an anchorage adapter having a central sleeve mounted on an unthreaded portion of said rod adjacent said knob;

d. means for preventing axial movement of said rod relative to said adapter while allowing free rotation of said rod within said adapter;

e. said rod, anchorage adapter, and knob being separate from said cartridge and said plunger until dispensing of material from said cartridge is to commence; and f. manually operable means for releasably securing said anchorage adapter to the rear end of said cartridge after said rod is threaded through said plunger and said seal to bring said adapter adjacent said rear end of said cartridge.

2. The dispenser of claim 1 wherein said rod, adapter, and knob are all formed of molded resin.

3. The dispenser of claim 1 wherein the end of said rod opposite said knob is pointed.

4. The dispenser of claim 3 including a seal arranged over said nozzle opening of said cartridge to be punctured by said pointed end of said rod.

5. The dispenser of claim 1 wherein said cartridge is formed of one resin material, said adapter is formed of a harder resin material, and said means for securing said adapter to said cartridge includes self-tapping threads on said adapter.

6. The dispenser of claim 5 wherein said rod, adapter, and knob are all formed of molded resin.

7. The dispenser of claim 6 wherein the end of said rod opposite said knob is pointed.

8. The dispenser of claim 7 including a seal arranged over said nozzle opening of said cartridge to be punctured by said pointed end of said rod.

9. A method of dispensing material from a disposable cartridge having a disposable resin plunger positioned inward from the rear end of said cartridge and having a threaded and sealed central opening, said dispensing method using a threaded rod having a turning knob and a relatively rotatable anchorage adapter, and said method comprising:

a. turning said knob and said rod in one direction to thread said rod through said plunger and said seal and to advance said rod through said material to bring said adapter adjacent said rear end of said cartridge;

b. manually moving said adapter onto said rear end of said cartridge for removably securing said adapter to said rear end of said cartridge;

c. turning said knob in the opposite direction to advance said plunger into said cartridge to dispense said material; and d. turning said knob slightly in said one direction to retract said plunger to prevent drool upon interruption of said dispensing.

10. The method of claim 9 including screwing said adapter onto said rear end of said cartridge.

11. The method of claim 9 including removing said adapter from said rear end of said cartridge after completing said dispensing, and unthreading said rod from said plunger for reuse of said rod and said adapter.

12. The method of claim 11 including screwing said adapter onto said rear end of said cartridge.

* * * * *